US012747864B1

(12) United States Patent
Ganiger et al.

(10) Patent No.: US 12,747,864 B1
(45) Date of Patent: Sep. 29, 2026

(54) COMBUSTOR ASSEMBLY FOR A GAS TURBINE ENGINE

(71) Applicant: General Electric Company, Evendale, OH (US)

(72) Inventors: Ravindra Shankar Ganiger, Bangalore (IN); Steven Clayton Vise, Loveland, OH (US); Michael Anthony Benjamin, Cincinnati, OH (US); Sibtosh Pal, Mason, OH (US); Eyitayo James Owoeye, Houston, TX (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 19/289,415

(22) Filed: Aug. 4, 2025

(51) Int. Cl.
*F23R 3/60* (2006.01)
*F23R 3/00* (2006.01)

(52) U.S. Cl.
CPC ..... *F23R 3/60* (2013.01); *F23R 3/007* (2013.01); *F23R 2900/03041* (2013.01)

(58) Field of Classification Search
CPC ... F23R 3/007; F23R 3/60; F23R 2900/03041
See application file for complete search history.

(56) References Cited

U.S. PATENT DOCUMENTS 2,918,793 A * 12/1959 Jerie ..... F23R 3/002 60/755
2,919,549 A * 1/1960 Haworth ..... F23R 3/002 431/351
4,480,436 A * 11/1984 Maclin ..... F23R 3/002 60/757
4,614,082 A * 9/1986 Sterman ..... F23R 3/002 60/800
5,079,915 A * 1/1992 Veau ..... F02K 1/822 60/753
5,318,402 A * 6/1994 Bailey ..... F01D 11/005 415/173.1
6,725,666 B2 * 4/2004 Tiemann ..... F23R 3/005 60/757
7,942,004 B2 * 5/2011 Hodder ..... F23R 3/002 52/509
8,052,155 B2 11/2011 Amos et al.
8,359,865 B2 1/2013 Dierberger et al.
9,423,129 B2 8/2016 Graves et al.
9,587,832 B2 3/2017 Dierberger
9,605,550 B2 3/2017 Graves
10,307,873 B2 * 6/2019 Hucker ..... F23R 3/50
10,502,421 B2 * 12/2019 Harding ..... F02C 7/20
10,634,350 B2 * 4/2020 Harding ..... F23R 3/002
10,808,553 B2 10/2020 Whittle et al.
(Continued)

*Primary Examiner* — Lorne E Meade
(74) *Attorney, Agent, or Firm* — Dority & Manning, P.A.

(57) ABSTRACT

A combustor assembly for a gas turbine engine includes a combustor defining a combustion chamber. The combustor assembly includes a combustor liner support shell, and a plurality of liner tiles defining at least part of the combustion chamber. Each liner tile of the plurality of liner tiles defines a protrusion and a recess opposite the protrusion where the recess is configured to at least partially receive the protrusion of an adjacent liner tile of the plurality of liner tiles. A fastener assembly is at least partially disposed in the recess for coupling a respective liner tile to the combustor liner support shell.

17 Claims, 8 Drawing Sheets

(56) References Cited

U.S. PATENT DOCUMENTS

| | | | | |
|---|---|---|---|---|
| 10,816,201 | B2 | 10/2020 | Drake | |
| 11,226,099 | B2 * | 1/2022 | Freeman | F23R 3/60 |
| 11,466,855 | B2 * | 10/2022 | Freeman | F23M 5/04 |
| 11,543,132 | B2 | 1/2023 | Kobayashi et al. | |
| 11,859,819 | B2 | 1/2024 | Jones et al. | |
| 2023/0296261 | A1 | 9/2023 | Kahane et al. | |

* cited by examiner

COMBUSTOR ASSEMBLY FOR A GAS TURBINE ENGINE

FIELD

The present subject matter relates generally to a gas turbine engine, or more particularly to a combustor assembly for a gas turbine engine.

BACKGROUND

A gas turbine engine generally includes a fan and a core arranged in flow communication with one another. In addition, the core of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gasses through the turbine section drives the turbine section and is then routed through the exhaust section, e.g., to the atmosphere.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

Figure 1:
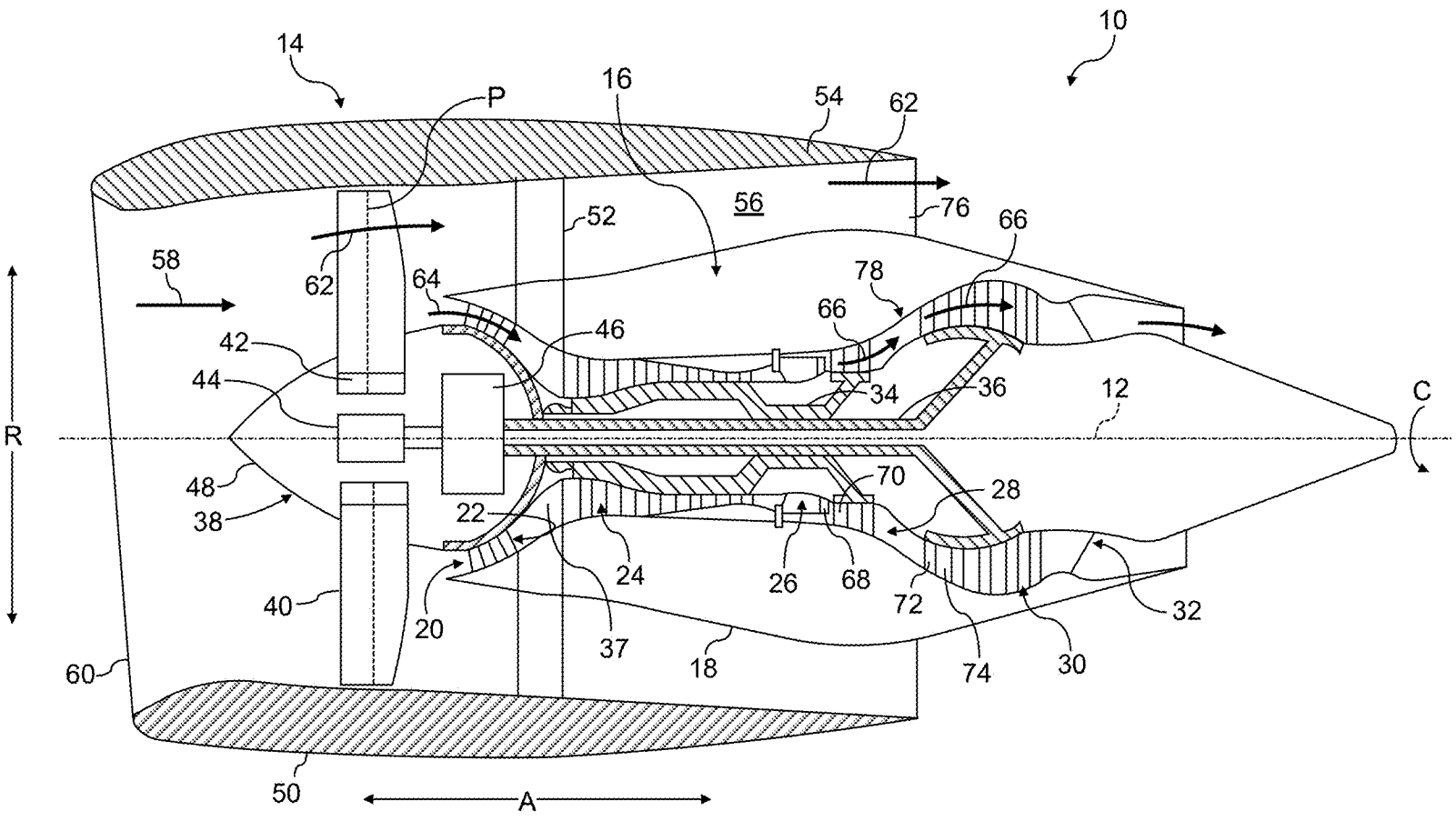
FIG. 1 provides a schematic view of an exemplary gas turbine engine in accordance with one or more embodiments of the present disclosure.

Repeat use of reference characters in the present specification and drawings is intended to represent the same or analogous features or elements of the present disclosure.

DETAILED DESCRIPTION

Reference now will be made in detail to embodiments of the present disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the present disclosure. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The singular forms "a", "an", and "the" include plural references unless the context clearly dictates otherwise.

The term "at least one of" in the context of, e.g., "at least one of A, B, or C" refers to only A, only B, only C, or any combination of A, B, and C.

The terms "coupled," "fixed," "attached to," and the like refer to both direct coupling, fixing, or attaching, as well as indirect coupling, fixing, or attaching through one or more intermediate components or features, unless otherwise specified herein.

As used herein, the terms "first," "second," and "third" may be used interchangeably to distinguish one component from another and are not intended to signify location or importance of the individual components.

For purposes of the description hereinafter, the terms "upper", "lower", "right", "left", "vertical", "horizontal", "top", "bottom", "lateral", "longitudinal", and derivatives thereof shall relate to the embodiments as they are oriented in the drawing figures. However, it is to be understood that the embodiments may assume various alternative variations, except where expressly specified to the contrary. It is also to be understood that the specific devices illustrated in the attached drawings, and described in the following specification, are simply exemplary embodiments of the disclosure. Hence, specific dimensions and other physical characteristics related to the embodiments disclosed herein are not to be considered as limiting.

As used herein, the terms "integral", "unitary", or "monolithic" as used to describe a structure refers to the structure being formed integrally of a continuous material or group of materials with no seams, connections joints, or the like. The integral, unitary structures described herein may be formed through additive manufacturing to have the described structure, or alternatively through a casting process, etc.

The term "unitary" as used herein denotes that the final component has a construction in which the integrated portions are inseparable and is different from a component comprising a plurality of separate component pieces that have been joined together but remain distinct and the single component is not inseparable (i.e., the pieces may be reseparated). Thus, unitary components may comprise generally substantially continuous pieces of material or may comprise a plurality of portions that are permanently bonded to one another. In any event, the various portions forming a unitary component are integrated with one another such that the unitary component is a single piece with inseparable portions.

The term "adjacent" as used herein with reference to two walls and/or surfaces refers to the two walls and/or surfaces contacting one another, or the two walls and/or surfaces being separated only by one or more nonstructural layers and the two walls and/or surfaces and the one or more nonstructural layers being in a serial contact relationship (i.e., a first wall/surface contacting the one or more nonstructural layers, and the one or more nonstructural layers contacting the a second wall/surface.

The term "proximate" refers to being closer to one end than an opposite end. For example, when used in conjunction with first and second ends; high pressure and low pressure sides; or the like, the phrase "proximate the first end," or "proximate the high pressure side," refers to a location closer to the first end than the second end, or closer to the high pressure side than the low pressure side, respectively.

The terms "upstream" and "downstream" refer to the relative direction with respect to fluid flow in a fluid pathway. For example, "upstream" refers to the direction from which the fluid flows, and "downstream" refers to the direction to which the fluid flows. Terms of approximation, such as "about" or "approximately," refer to being within a ten percent margin of error.

The term "turbomachine" refers to a machine including one or more compressors, a heat generating section (e.g., a combustion section), and one or more turbines that together generate a torque output.

The term "gas turbine engine" refers to an engine having a turbomachine as all or a portion of its power source. Example gas turbine engines include turbofan engines, turboprop engines, turbojet engines, turboshaft engines, etc., as well as hybrid-electric versions of one or more of these engines.

The term "combustion section" refers to any heat addition system for a turbomachine. For example, the term combustion section may refer to a section including one or more of a deflagrative combustion assembly, a rotating detonation combustion assembly, a pulse detonation combustion assembly, or other appropriate heat addition assembly. In certain example embodiments, the combustion section may include an annular combustor, a can combustor, a cannular combustor, a trapped vortex combustor (TVC), or other appropriate combustion system, or combinations thereof.

The terms "low" and "high", or their respective comparative degrees (e.g., -er, where applicable), when used with a compressor, a turbine, a shaft, or spool components, etc. each refer to relative speeds within an engine unless otherwise specified. For example, a "low turbine" or "low speed turbine" defines a component configured to operate at a rotational speed, such as a maximum allowable rotational speed, lower than a "high turbine" or "high speed turbine" of the engine.

The terms "forward" and "aft" refer to relative positions within a gas turbine engine or vehicle, and are based on a normal operational attitude of the gas turbine engine or vehicle. More particularly, forward and aft are used herein with reference to a direction of travel of the vehicle and a direction of propulsive thrust of the gas turbine engine.

As used herein, the terms "axial" and "axially" refer to directions and orientations that extend substantially parallel to a centerline of the gas turbine engine. Moreover, the terms "radial" and "radially" refer to directions and orientations that extend substantially perpendicular to the centerline of the gas turbine engine. In addition, as used herein, the terms "circumferential" and "circumferentially" refer to directions and orientations that extend arcuately about the centerline of the gas turbine engine.

A combustor liner of a combustor of a gas turbine engine is typically supported by a support structure. During operation, combustors typically experience variations in temperature. Thus, combustor materials expand when heated, and variations in temperature result in different amounts of thermal expansion or contraction of different portions of the combustor liner. Also, the support structure may have a coefficient of thermal expansion or contraction that is different from the coefficient of thermal expansion or contraction of the combustor liner material. Accordingly, thermal stress may be induced in the combustor liner due to differential expansion within the combustor liner itself and with respect to the combustor liner support structure.

Embodiments of the present disclosure provide a combustor assembly for a gas turbine engine including a plurality of liner tiles defining at least a portion of a combustor liner of a combustor of a gas turbine engine. The liner tiles may be metallic or non-metallic. By way of non-limiting example, non-metallic liner tiles may be made from a ceramic material such as a ceramic matrix composite (CMC) material. Embodiments of the present disclosure interlock the liner tiles together and/or to a combustor liner support assembly using a number of different techniques that shield the connection arrangement from direct impingement by combustion gases present within the combustion chamber. In one exemplary embodiment, the connection arrangement uses a combination of recesses and protrusions arranged such that fastening elements are positioned within the recesses such that the fastening elements are not exposed within the combustion chamber. In exemplary embodiments, the interlocking of the liner tiles also permits the liner tiles to expand or contract in response to thermal cycling. This flexibility can allow for controlled movement of each liner tile within defined limits, thereby improving durability by reducing undesired thermally-induced stress concentrations at the tile joints.

Referring now to the drawings, wherein identical numerals indicate the same elements throughout the Figures, FIG. 1 is a schematic cross-sectional view of a gas turbine engine 10 in accordance with an exemplary embodiment of the present disclosure. More particularly, for the embodiment of FIG. 1, the gas turbine engine is a high-bypass turbofan jet engine, sometimes also referred to as a "turbofan engine." As shown in FIG. 1, the gas turbine engine 10 defines an axial direction A (extending parallel to a longitudinal axis 12 provided for reference), a radial direction R, and a circumferential direction C extending about the longitudinal axis 12. In general, the gas turbine engine 10 includes a fan section 14 and a turbomachine 16 disposed downstream from the fan section 14.

The exemplary turbomachine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft 34 (which may additionally or alternatively be a spool) drivingly connects the HP turbine 28 to the HP compressor 24. A low pressure (LP) shaft 36 (which may additionally or alternatively be a spool) drivingly connects the LP turbine 30 to the LP compressor 22. The compressor section, combustion section 26, turbine section, and jet exhaust nozzle section 32 together define a working gas flowpath 37.

For the embodiment depicted, the fan section 14 includes a fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable pitch change mechanism 44 configured to collectively vary the pitch of the fan blades 40, e.g., in unison. The gas turbine engine 10 further includes a power gearbox 46, and the fan blades 40, disk 42, and pitch change mechanism 44 are together rotatable about the longitudinal axis 12 by LP shaft 36 across the power gearbox 46. The power gearbox 46 includes a plurality of gears for adjusting a rotational speed of the fan 38 relative to a rotational speed of the LP shaft 36, such that the fan 38 may rotate at a more efficient fan speed.

Referring still to the exemplary embodiment of FIG. 1, the disk 42 is covered by a rotatable front hub 48 of the fan section 14 (sometimes also referred to as a "spinner"), the front hub 48 aerodynamically contoured to promote an airflow through the plurality of fan blades 40.

Additionally, the exemplary fan section 14 includes an annular fan casing or outer nacelle 50 that circumferentially surrounds the fan 38 and/or at least a portion of the turbomachine 16. It should be appreciated that the outer nacelle 50 is supported relative to the turbomachine 16 by a plurality of circumferentially-spaced outlet guide vanes 52 in the embodiment depicted. Moreover, a downstream section 54 of the outer nacelle 50 extends over an outer portion of the turbomachine 16 so as to define a bypass airflow passage 56 therebetween.

During operation of the gas turbine engine 10, a volume of air 58 enters the gas turbine engine 10 through an associated inlet 60 of the outer nacelle 50 and fan section 14. As the volume of air 58 passes across the fan blades 40, a first portion of air 62 is directed or routed into the bypass airflow passage 56 and a second portion of air 64 is directed or routed into the working gas flowpath 37, or more specifically into the LP compressor 22. The ratio between the first portion of air 62 and the second portion of air 64 is commonly known as a bypass ratio. A pressure of the second portion of air 64 is then increased as it is routed through the HP compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft 34, thus causing the HP shaft 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft 36, thus causing the LP shaft 36 to rotate, thereby supporting operation of the LP compressor 22 and/or rotation of the fan 38.

The combustion gases 66 are subsequently routed through the jet exhaust nozzle section 32 of the turbomachine 16 to provide propulsive thrust.

Simultaneously, the pressure of the first portion of air 62 is substantially increased as the first portion of air 62 is routed through the bypass airflow passage 56 before it is exhausted from a fan nozzle exhaust section 76 of the gas turbine engine 10, also providing propulsive thrust. The HP turbine 28, the LP turbine 30, and the jet exhaust nozzle section 32 at least partially define a hot gas path 78 for routing the combustion gases 66 through the turbomachine 16.

It should be appreciated, however, that the exemplary gas turbine engine 10 depicted in FIG. 1 is by way of example only, and that in other exemplary embodiments, the gas turbine engine 10 may have any other suitable configuration. For example, although the gas turbine engine 10 depicted is configured as a ducted gas turbine engine (i.e., including the outer nacelle 50), in other embodiments, the gas turbine engine 10 may be an unducted gas turbine engine (such that the fan 38 is an unducted fan, and the outlet guide vanes 52 are cantilevered from the outer casing 18). Additionally, or alternatively, although the gas turbine engine 10 depicted is configured as a geared gas turbine engine (i.e., including the power gearbox 46) and a variable pitch gas turbine engine (i.e., including a fan 38 configured as a variable pitch fan), in other embodiments, the gas turbine engine 10 may additionally or alternatively be configured as a direct drive gas turbine engine (such that the LP shaft 36 rotates at the same speed as the fan 38), as a fixed pitch gas turbine engine (such that the fan 38 includes fan blades 40 that are not rotatable about a pitch axis P), or both. It should also be appreciated, that in still other exemplary embodiments, aspects of the present disclosure may be incorporated into any other suitable gas turbine engine. For example, in other exemplary embodiments, aspects of the present disclosure may (as appropriate) be incorporated into, e.g., a turboprop gas turbine engine, a turboshaft gas turbine engine, or a turbojet gas turbine engine.

Figure 2:
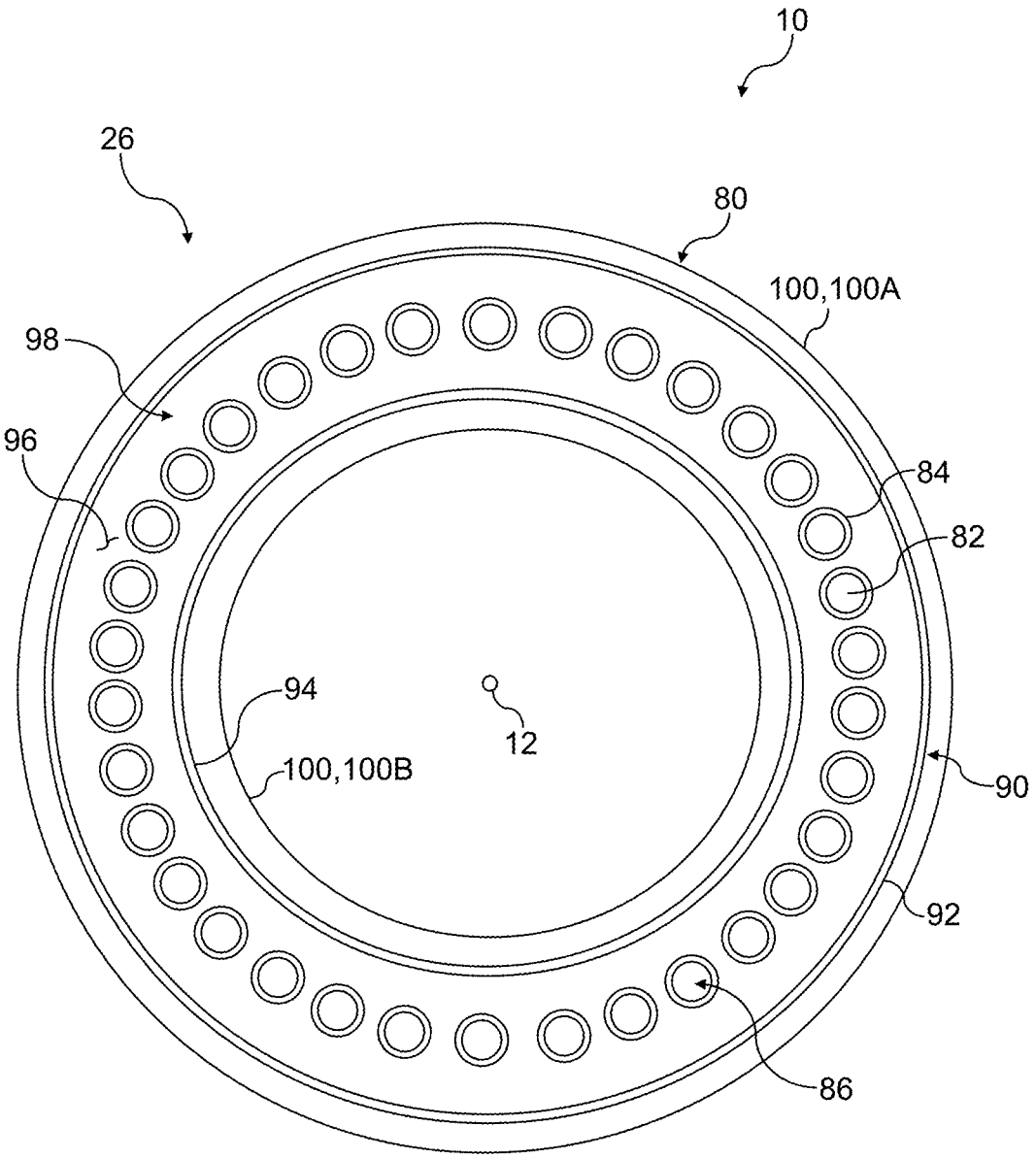
FIG. 2 provides a perspective, axial view of an exemplary combustor assembly in accordance with an exemplary embodiment of the present disclosure.

FIG. 2 is a schematic diagram depicting of a portion of the combustion section 26 viewed in an axially forward direction. In the embodiment illustrated in FIG. 2, the combustion section 26 includes a combustor assembly 80. The combustor assembly 80 may include a set of fuel injectors 82 annularly arranged about the longitudinal axis 12 of the gas turbine engine 10. A combustor 84 is fluidly connected to the set of fuel injectors 82 to define at least a portion of a set of fuel cups 86 annularly provided about the longitudinal axis 12.

A combustor liner 90 including an outer combustor liner 92 and an inner combustor liner 94 concentric with respect to each other and annular about the longitudinal axis 12 defines the combustor 84. The combustor liner 90 also further defines the set of fuel cups 86. A dome wall 96 together with the combustor liner 90 can define a combustion chamber 98 of the combustor 84 annular about the longitudinal axis 12. The set of fuel cups 86 can be fluidly coupled to the combustion chamber 98.

The combustor 84 can have a can, can-annular, or annular arrangement depending on the type of engine in which the combustor 84 is located. The combustor liner 90 can also have a varying geometry. The outer combustor liner 92 and the inner combustor liner 94 may each be supported by a combustor liner support assembly 100. In the embodiment illustrated in FIG. 2, the outer combustor liner 92 is supported by a combustor liner support assembly 100A, and the inner combustor liner 94 is supported by a combustor liner support assembly 100B.

Figure 3:
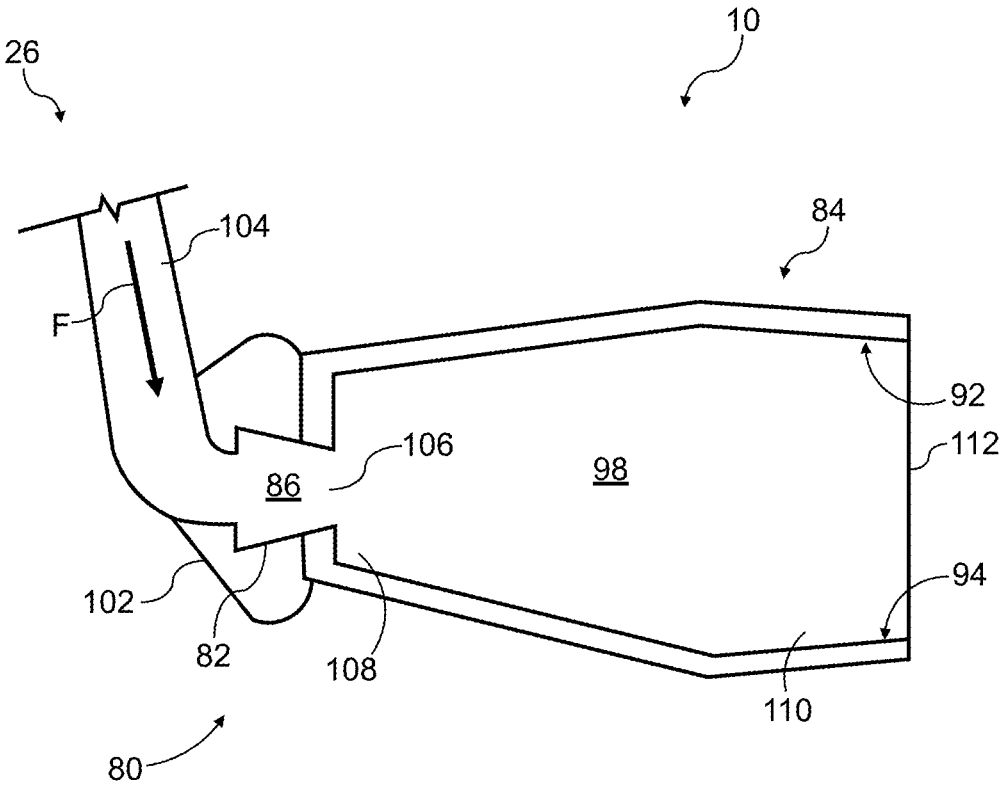
FIG. 3 is a schematic, side view of an exemplary combustor assembly in accordance with an exemplary embodiment of the present disclosure.

FIG. 3 depicts a schematic, cross-sectional view of a portion of the combustion section 26. A dome assembly 102 can house the fuel injector 82. The fuel injector 82 can be fluidly coupled to a fuel passageway 104 that is configured to receive a flow of fuel (F). The fuel injector 82 can terminate in a dome inlet 106 to define the fuel cup 86. The combustor 84 includes the combustion chamber 98 extending axially from a forward end 108 proximate to the dome inlet 106 to an aft end 110 proximate to a combustor outlet 112 and at least partially defined by the outer combustor liner 92 and the inner combustor liner 94.

Figure 4:
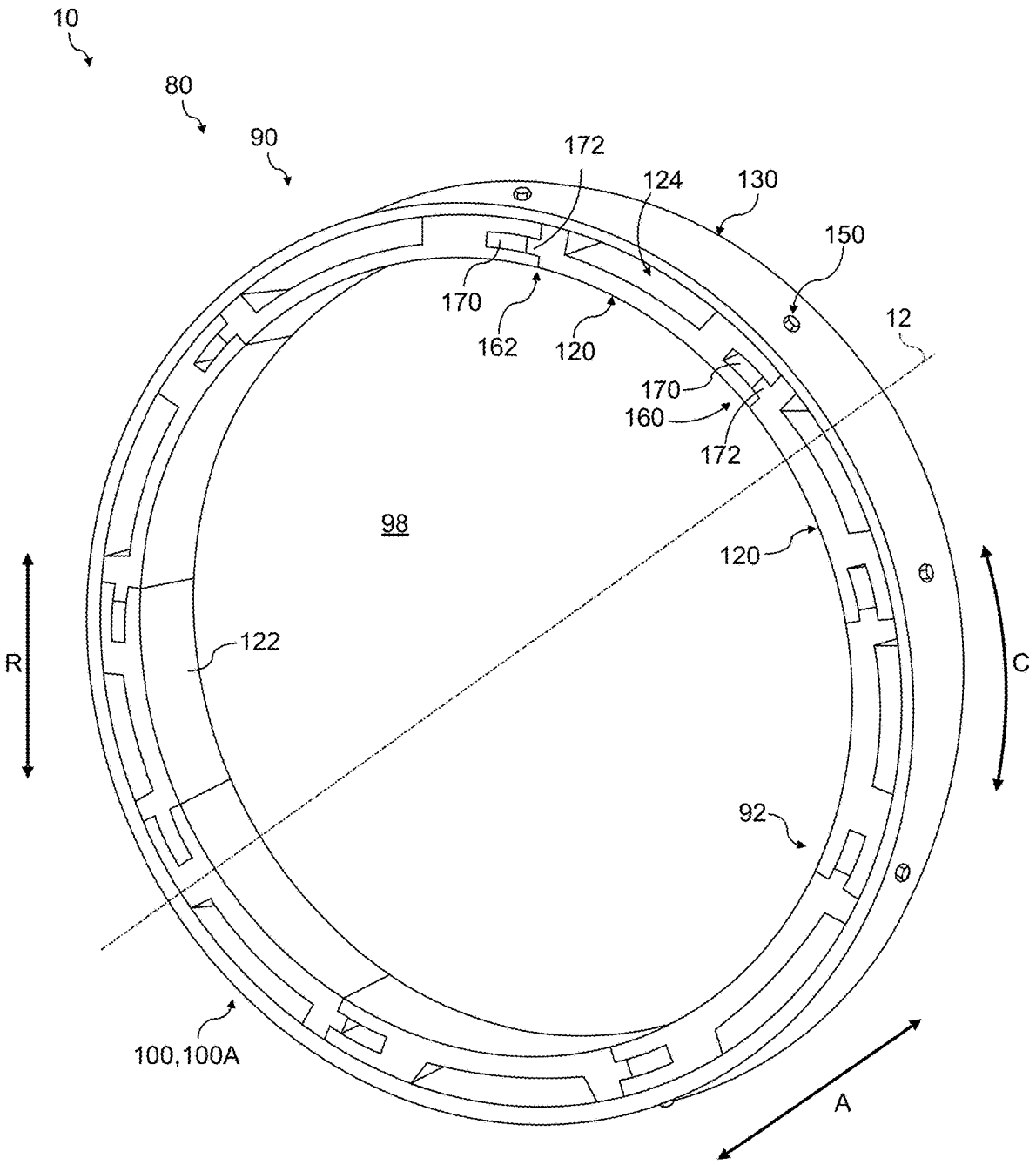
FIG. 4 is a schematic perspective view of a portion of an exemplary combustor assembly in accordance with an exemplary embodiment of the present disclosure.

FIG. 4 is a schematic diagram of a perspective view of a portion of the combustor assembly 80 in accordance with an exemplary aspect of the present disclosure. Although FIG. 4 depicts the outer combustor liner 92 and the combustor liner support assembly 100A, it should be understood that the inner combustor liner 94 (FIG. 3) and the combustor liner support assembly 100B (FIG. 3) may be similarly configured (e.g., by reversing the radial orientation and/or position of various structures. As shown in FIG. 4, the outer combustor liner 92 may be constructed from a plurality of liner tiles 120 arranged circumferentially about the longitudinal axis 12. The plurality of liner tiles 120 collectively define at least part of the combustion chamber 98. The combustor assembly 80 further includes the combustor liner support assembly 100A, which includes an annular combustor liner support shell 130. In exemplary embodiments, the combustor liner support shell 130 is positioned radially outward from the plurality of liner tiles 120. Each liner tile 120 of the plurality of liner tiles 120 defines an inner surface of liner tile 122 facing the combustion chamber 98 and an outer surface of liner tile 124 facing generally toward the combustor liner support shell 130.

To facilitate assembly and accommodate thermal growth, the individual liner tiles 120 are configured to interlock with one another. Specifically, each liner tile of the plurality of liner tiles 120 defines a liner tile end 160 and another liner tile end 162 opposite the liner tile end 160. Furthermore, each liner tile 120 of the plurality of liner tiles 120 defines a protrusion 172 and a recess 170 opposite the protrusion 172. In the exemplary embodiment shown in FIG. 4, the recess 170 is positioned at the liner tile end 160, and the protrusion 172 is positioned at the liner tile end 162. Accordingly, the recess 170 of a given liner tile 120 is configured to at least partially receive the protrusion 172 of an adjacent liner tile 120 of the plurality of liner tiles 120, thereby creating an interlocking circumferential ring of liner tiles 120. The recess 170 and the protrusion 172 may be configured or sized to interlock the liner tiles 120 but permit limited movement of the liner tiles 120 with respect to each other and the combustor liner support shell 130 to enable expansion and contraction in response to thermal gradients within the combustion chamber 98.

The combustor assembly 80 also includes a fastener assembly 150 for securing the liner tiles 120 to the combustor liner support shell 130. As will be described in greater detail below, the fastener assembly 150 is at least partially disposed in the recess 170 for coupling a respective liner tile 120 to the combustor liner support shell 130. By placing the fastener assembly 150 at least partially within the recess 170, the fastener assembly 150 is shielded from the high-temperature environment of the combustion chamber 98, which can improve its durability and operational life. This arrangement securely mounts the plurality of liner tiles 120 to form the outer combustor liner 92 while allowing for relative thermal movement between adjacent liner tiles 120 and between the liner tiles 120 and the combustor liner support shell 130, thereby reducing thermally induced stresses within the combustor assembly 80 of the gas turbine engine 10.

Figure 5:
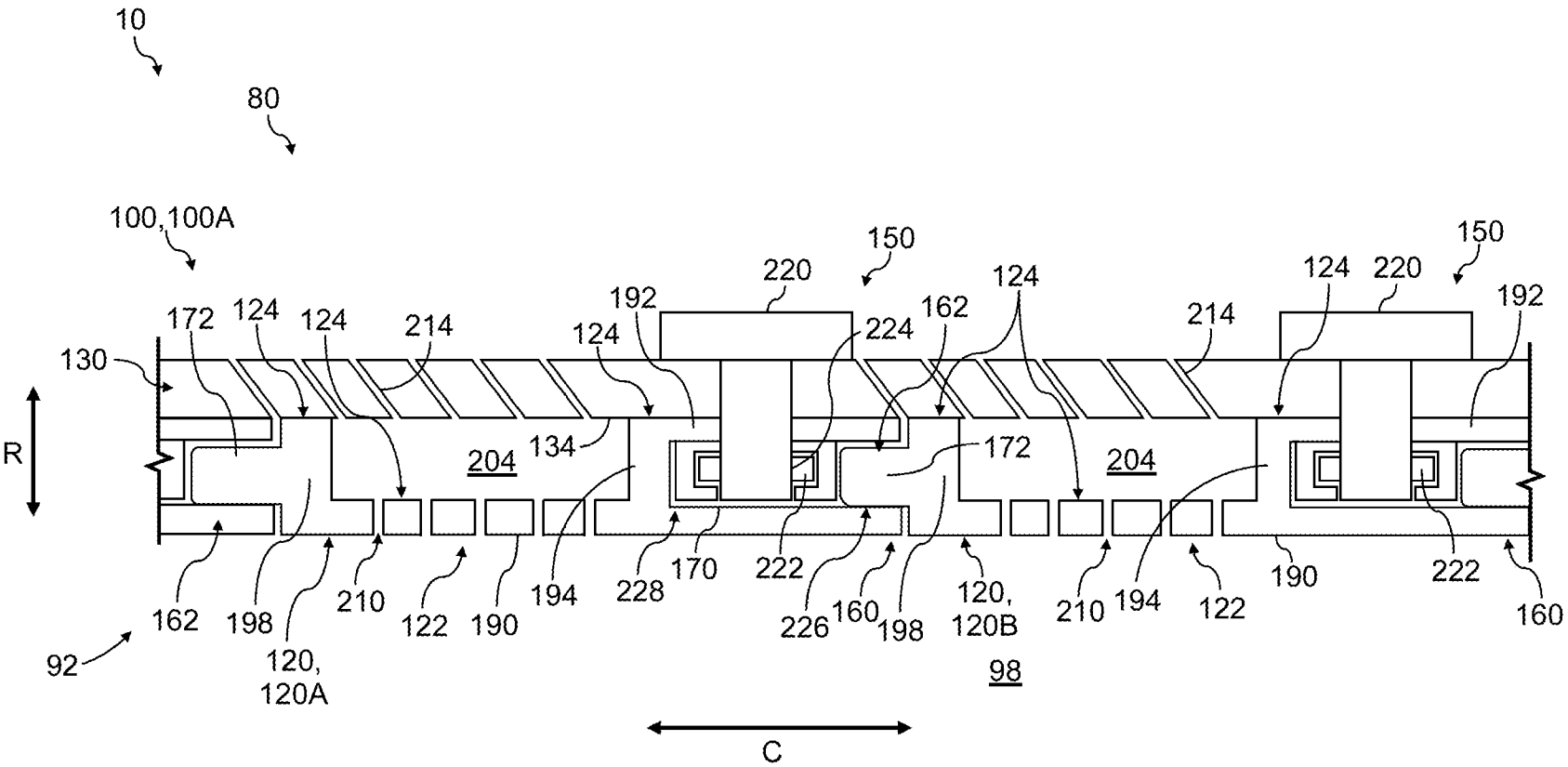
FIG. 5 is a schematic enlarged view of a portion of an exemplary combustor assembly in accordance with an exemplary embodiment of the present disclosure.

FIG. 5 is a schematic, enlarged view of a portion of the combustor assembly 80, illustrating the interlocking arrangement of a plurality of the liner tiles 120 according to an exemplary embodiment of the present disclosure. The exemplary combustor assembly 80 of FIG. 5 may be configured in substantially the same manner as the exemplary combustor assembly 80 of FIGS. 2 and 3, and accordingly, the same or similar numbers may refer to the same or similar parts. In the embodiment depicted in FIG. 5, the liner tiles 120 are depicted extending in the circumferential direction C such that the respective recesses 170 and protrusions 172 are facing or extending in the circumferential direction C (e.g., the liner tile ends 160 and 162 being circumferential ends of the liner tiles 120). However, it should be understood that, alternatively or additionally, the liner tiles 120 may be arranged such that the respective recesses 170 and protrusions 172 are facing or extending in the axial direction A (in-and-out of the page of FIG. 5).

As shown in FIG. 5, a plurality of the liner tiles 120 are positioned adjacent each other in the circumferential direction C. By way of non-limiting example, one liner tile 120, identified as a liner tile 120A in FIG. 5, is positioned adjacent another liner tile 120, identified as a liner tile 120B in FIG. 5. The liner tiles 120A, 120B extend along the circumferential direction C such that the liner tile ends 160 and 162 of the respective liner tiles 120A, 120B are circumferential ends of the liner tiles 120A, 120B. Each of the liner tiles 120 define a liner tile panel 190 defining at least part of the combustion chamber 98 and extending from the liner tile end 160 to the liner tile end 162. Each liner tile 120 further include an attachment flange 192 that is spaced apart from the liner tile panel 190 to define the recess 170. In the embodiment depicted in FIG. 5, the combustor liner support shell 130 defines an inner surface 134 facing toward the liner tiles 120 and the combustion chamber 98, and the attachment flange 192 is positioned against the inner surface 134 of the combustor liner support shell 130.

As depicted in FIG. 5, the recess 170 is positioned at the liner tile end 160 of each liner tile 120, and the protrusion 172 is positioned at the liner tile end 162 of each liner tile 120. With the recess 170 positioned opposite the protrusion 172 on each liner tile 120 (e.g., the recess 170 positioned on a circumferential end of the liner tile 120 opposite the other circumferential end of the liner 120), the liner tiles 120 are arranged such that the protrusion 172 of each liner tile 120 fits into the recess 170 of an adjacent liner tile 120. By way of non-limiting example, the liner tile end 162 of the liner tile 120B is positioned adjacent the liner tile end 160 of the liner tile 120A. As such, the recess 170 of the liner tile 120A faces the protrusion 172 of the liner tile 120B. This arrangement of the liner tiles 120 may be repeated around the circumference of the combustion chamber 98. A support flange 194 extends radially from the liner tile panel 190 to the attachment flange 192. Together, the liner tile panel 190, the attachment flange 192, and the support flange 194 define the recess 170. The recess 170 has an open end 226 at the liner tile end 160, and the support flange 194 defines a closed end 228 of the recess 170. During assembly, the recess 170 is configured to at least partially receive the protrusion 172 of an adjacent liner tile 120. As depicted in FIG. 5, the protrusion 172 of the liner tile 120B is positioned within the open end 226 of the recess 170 of the liner tile 120A.

Each liner tile 120 also includes a support leg 198 extending radially from the liner tile panel 190 toward the combustor liner support shell 130 and spaced apart from the support flange 194. The support leg 198 of the liner tile 120 supports the protrusion 172. The arrangement of the liner tile panel 190, the support flange 194, and the support leg 198 defines a cooling air cavity 204 between the respective liner tile 120 and the combustor liner support shell 130. In exemplary embodiments, the liner tile panel 190 defines one or more liner tile cooling apertures 210, and the combustor liner support shell 130 defines one or more support shell apertures 214. This configuration allows a cooling airflow to flow from outside the combustor liner support shell 130, through the support shell apertures 214 and into the cooling air cavity 204. This way, the cooling air cavity 204 acts as an air recirculation zone by enabling formation of a cooling air flow vortex between the combustor liner support shell 130 and the liner tile 120. The low pressure in this air flow vortex increases the flow velocity and dwell time of the cooling air and enhances cooling of the outer surface 124 of the liner tile 120. The cooling airflow may also flow from the cooling air cavity 204 through the liner tile cooling apertures 210 to provide film cooling to the liner tile 120. In FIG. 5, the liner tile cooling apertures 210 are depicted extending in the radial direction R, and the support shell apertures 214 are depicted at a non-parallel angle with respect to the radial direction R. However, it should be understood that, based on factors such as, by way of non-limiting example, the direction of a supply of the cooling airflow, the thermal gradients to be controlled, or the position or orientation of the liner tiles 120, the directional angles of the support shell apertures 214 and/or the liner tile cooling apertures 210 may be varied.

As depicted in FIG. 5, the fastener assembly 150 is at least partially disposed in the recess 170 for coupling a respective liner tile 120 to the combustor liner support shell 130. The fastener assembly 150 comprises a fastener 220 and a securing member 222 for engaging the fastener 220. At least a portion of the fastener assembly 150, specifically the fastener 220, extends through the attachment flange 192 and the combustor liner support shell 130. The securing member 222 is positioned within the recess 170 to engage the fastener 220, thereby coupling the attachment flange 192 to the combustor liner support shell 130. As shown, the fastener assembly 150 is at least partially disposed between the closed end 228 of the recess 170 and the protrusion 172 of the adjacent liner tile 120. The fastener 220 may be a bolt, and the securing member 222 may be a nut or a nutplate secured to the liner tile 120 within the recess 170.

Figure 6:
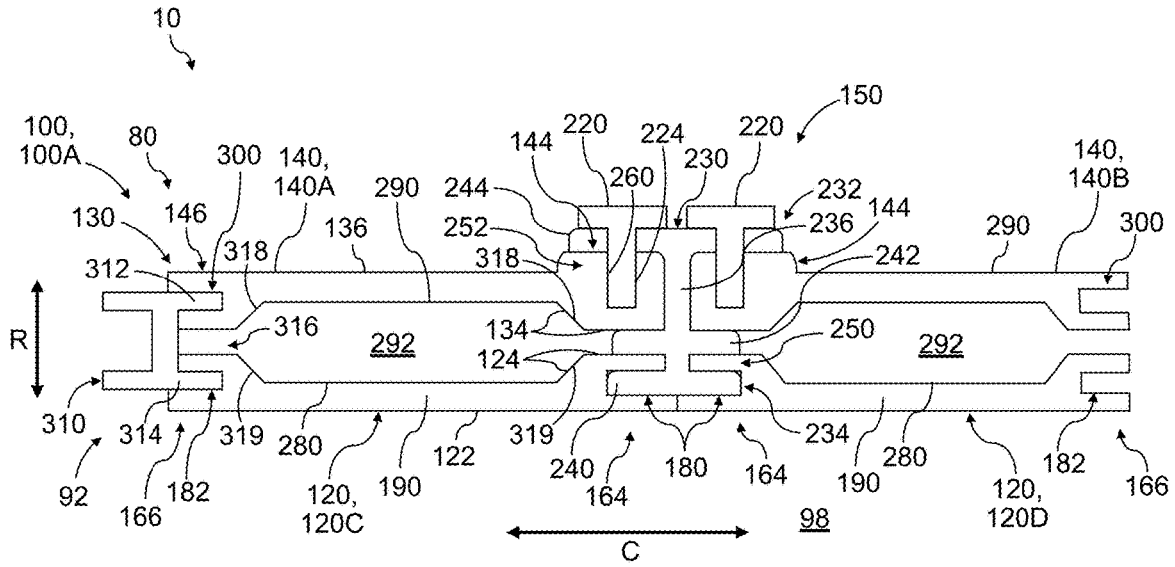
FIG. 6 is a schematic enlarged view of a portion of an exemplary combustor assembly in accordance with an exemplary embodiment of the present disclosure.

FIG. 6 is a schematic, enlarged view of a portion of the combustor assembly 80 in accordance with an exemplary aspect of the present disclosure. The exemplary combustor assembly 80 of FIG. 6 may be configured in substantially the same manner as the exemplary combustor assembly of FIGS. 2-5, and accordingly, the same or similar numbers may refer to the same or similar parts. However, for the embodiment of FIG. 6, an alternative arrangement for securing and interlocking the plurality of liner tiles 120 is provided.

As shown in FIG. 6, the plurality of liner tiles 120 includes one liner tile 120, identified as a liner tile 120C in FIG. 6, positioned adjacent another liner tile 120, identified as a liner tile 120D in FIG. 6, along the circumferential direction C. The combustor liner support shell 130 may comprise a plurality of combustor liner support shell portions 140. By way of non-limiting example, the combustor liner support shell 130 may be an annular component extending substantially 360 degrees in the circumferential direction C, or may be formed of a plurality of combustor liner support shell portions 140 each extending for a partial circumferential span less than 360 degrees in the circumferential direction. In the embodiment depicted in FIG. 6, two combustor liner support shell portions 140A, 140B are depicted positioned adjacent each other in the circumferential direction C. In the exemplary embodiment depicted in FIG. 6, the fastener assembly 150 may include a pair of the fasteners 220 coupled to an insert 230 to couple respective ends of the combustor liner support shell portions 140A, 140B together, and to couple the adjacent liner tiles 120C, 120D to the combustor liner support shell portions 140A, 140B.

In the embodiment depicted in FIG. 6, each of the liner tiles 120 defines a recess 180 at a liner tile end 164 of the liner tile 120, and a recess 182 at an opposite liner tile end 166 of the liner tile 120. Thus, in the embodiment depicted in FIG. 6, the liner tile ends 164, 166 define oppositely disposed circumferential ends of the liner tile 120. The liner tile 120D may be configured the same as the liner tile 120C but oriented 180 degrees with respect to the circumferential direction C (e.g., such that the liner tile end 164 of the liner tile 120C is positioned adjacent the liner tile end 164 of the liner tile 120D such their respective recesses 180 face each other).

In the embodiment illustrated in FIG. 6, the insert 230 is an elongate member defining an end 232 and an end 234 opposite the end 232. The end 232 is positioned radially outward of the end 234. The end 234 of the insert 230 includes a protrusion 240. The insert 230 also includes a protrusion 242 positioned spaced outwardly from the protrusion 240 in the radial direction R, defining an insert recess 250 therebetween. The protrusion 240 is disposed in the recesses 180 of the adjacent liner tiles 120C, 120D. The protrusion 242 is disposed between the outer surfaces 124 of the liner tiles 120C, 120D and the inner surface 134 of the combustor liner support shell 130 that, in the embodiment illustrated in FIG. 6, is defined by each of the combustor liner support shell portions 140A, 140B. The insert 230 further defines a protrusion 244 at the end 232, and the insert 230 defines a portion 236 extending from the protrusion 242 radially outward to the protrusion 244. The portion 236 of the insert 230 is positioned between the adjacent combustor liner support shell portions 140A, 140B. The protrusions 242 and 244 define an insert recess 252 therebetween.

The combustor liner support shell portions 140A, 140B each define an end portion 144 that is positioned in the insert recess 252. The end portions 144 of the combustor liner support shell portions 140A, 140B define an internally threaded bore 260, and the fastener assembly includes the fastener 220 having an externally threaded portion 224 that threadably engages the internally threaded bore 260 to couple the end 232 of the insert 230 to the combustor liner support shell 130. In the embodiment illustrated in FIG. 6, the fastener 220 extends through the protrusion 244 and threadably engages the internally threaded bore 260 in a respective end portion 144 of the respective liner tile 120C, 120D.

At other locations, the liner tiles 120 may be coupled to the combustor liner support shell 130 using a connector element 310. As depicted in FIG. 6, the liner tile end 166 of the liner tile 120 defines the recess 182. Similarly, an end portion 146 of each combustor liner support shell portion 140 opposite the end portion 144 defines a recess 300. The connector element 310 has a pair of radially spaced apart protrusions 312, 314 defining a connector element recess 316 therebetween. The protrusion 314 is disposed in the recess 182 of the liner tile 120, and the protrusion 312 is disposed in the recess 300 of the combustor liner support shell portion 140. Thus, a portion of the liner tile end 166 of the liner tile 120, and a portion of the end portion 146 of the combustor liner support shell portion 140 is positioned in the connector element recess 316. This interlocking arrangement allows for relative thermal movement while maintaining the position of the liner tiles 120 relative to the combustor liner support shell 130.

To facilitate cooling, one or more of the liner tiles may define a liner tile channel 280 defined on the outer surface 124 of the liner tile 120. Correspondingly, the inner surface 134 of the combustor liner support shell 130 may define a support shell channel 290 facing the liner tile channel 280. Together, the liner tile channel 280 and the support shell channel 290 can define a passage for cooling air to flow into and along a cooling air cavity 292 defined between the liner tile channel 280 and the support shell channel 290 and further bounded between the connector element 310 and the insert 230. The cooling air cavity 292 serves as an air recirculation zone similar to the cooling air cavity 204 described previously in FIG. 5. As depicted in FIG. 6, the support shell channel 290 is at least partly defined by a pair of sloped surfaces 318 formed at the end portions 144, 146 of the inner surface 134 of the combustor liner support shell 130 (e.g., on the inner surface 134 of the combustor liner support shell portions 140A, 140B in FIG. 6). The liner tile channel 280 is at least partly defined by a pair of sloped surfaces 319 formed at the liner tile ends 164, 166 of the outer surface 124 of the liner tile 120. The sloped surfaces 318, 319 together create localized pressure gradients for the cooling airflow, which reduces the airflow momentum and causes formation of turbulent wakes near the sloped surfaces 318, 319. These turbulent wakes enhance air recirculation in the cooling air cavity 292, thereby increasing the cooling effect on the outer surface 124 of the liner tile 120. Further, the recesses 180, 182, 300, the protrusions 240, 242, 244, 312, 314, and/or the end portions 144 of the combustor liner support shell portions 140A, 140B may be configured or sized to interlock the liner tiles 120 but permit limited movement of the liner tiles 120 and/or combustor liner support shell portions 140A, 140B with respect to each other to enable expansion and contraction in response to thermal gradients within the combustion chamber 98.

Figure 7:
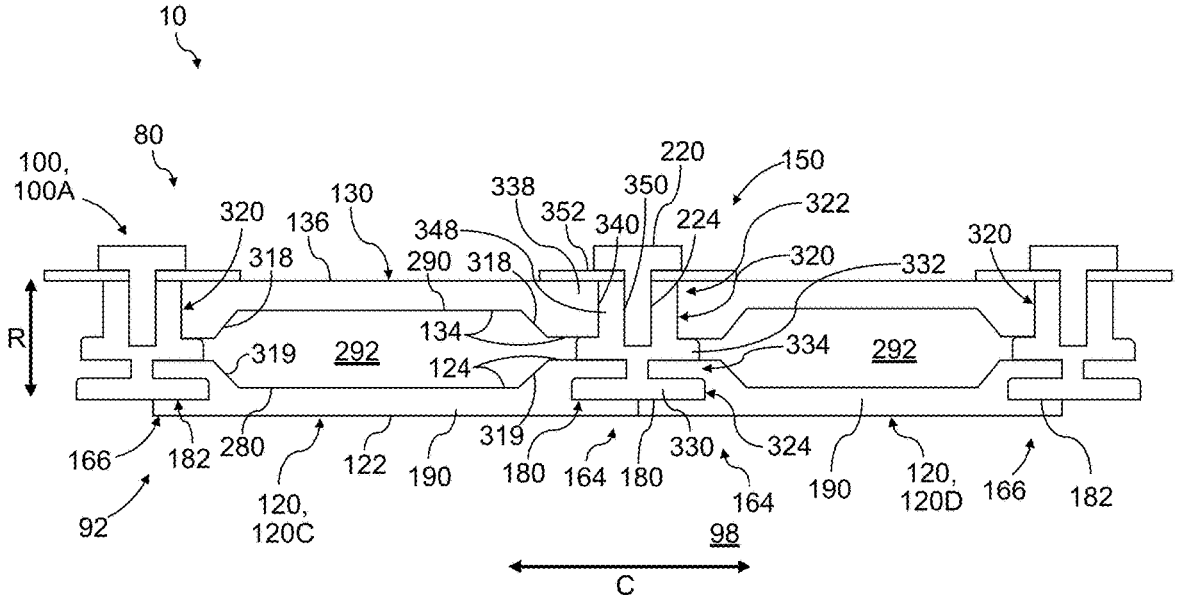
FIG. 7 is a schematic enlarged view of a portion of an exemplary combustor assembly in accordance with an exemplary embodiment of the present disclosure.

FIG. 7 is a schematic, enlarged view of a portion of the combustor assembly 80 in accordance with an exemplary aspect of the present disclosure. The exemplary combustor assembly 80 of FIG. 7 may be configured in substantially the same manner as the exemplary combustor assembly 80 of FIG. 2-6, and accordingly, the same or similar numbers may refer to the same or similar parts. For example, the exemplary combustor assembly 80 of FIG. 7 generally includes the combustor liner support shell 130 and a plurality of the liner tiles 120 defining at least part of a combustion chamber 98. In the embodiment depicted in FIG. 7, the plurality of liner tiles 120 include the liner tiles 120C, 120D as depicted and described in connection with FIG. 6, the same or similar numbers referring to the same or similar parts. In the embodiment illustrated in FIG. 7, the fastener assembly 150 includes a fastener 220 coupled to an insert 320 to secure the liner tiles 120 to the combustor liner support shell 130.

As in the previously described embodiment of FIG. 6, in FIG. 7, the liner tiles 120C, 120D each define respective recesses 180 that face each other. In the illustrated embodiment of FIG. 7, the insert 320 is an elongate member defining an end 322 and an end 324 opposite the end 322 in the radially inward direction. The insert 320 defines a protrusion 330 at the end 324, and a protrusion 332 spaced apart from the protrusion 330 in a radially outward direction to define an insert recess 334 therebetween. The protrusion 330 is disposed in the recesses 180 of the liner tiles 120C, 120D. The protrusion 332 is disposed between the outer surface 124 of the liner tiles 120C, 120D and the inner surface 134 of the combustor liner support shell 130.

In the embodiment depicted in FIG. 7, the combustor liner support shell 130 defines a radially extending aperture 340. The insert 320 defines an extension portion 348 extending radially outward from the protrusion 332 to the end 322. The extension portion 348 extends through the combustor liner support shell 130 via the aperture 340. The fastener 220 couples the end 322 of the insert 320 to the combustor liner support shell 130. More specifically, the end 322 of the insert 320 includes an internally threaded portion 350 to threadably engage the externally threaded portion 224 of the fastener 220. By way of non-limiting example, the first end of the insert 322 includes the internally threaded portion 350. In this configuration, the fastener 220 includes the externally threaded portion 224 for threadably engaging the internally threaded portion 350 of the insert 320. A plate 352 may be positioned between a head of the fastener 220 and an outer surface 136 of the combustor liner support shell 130. The plate 352 may be, by way of non-limiting example, a washer. The combustor liner support shell 130 may define a platform 338 of increased radial thickness in the region of the insert 320 such that at least a portion of the platform is positioned between the protrusion 332 and the plate 352.

Figure 8:
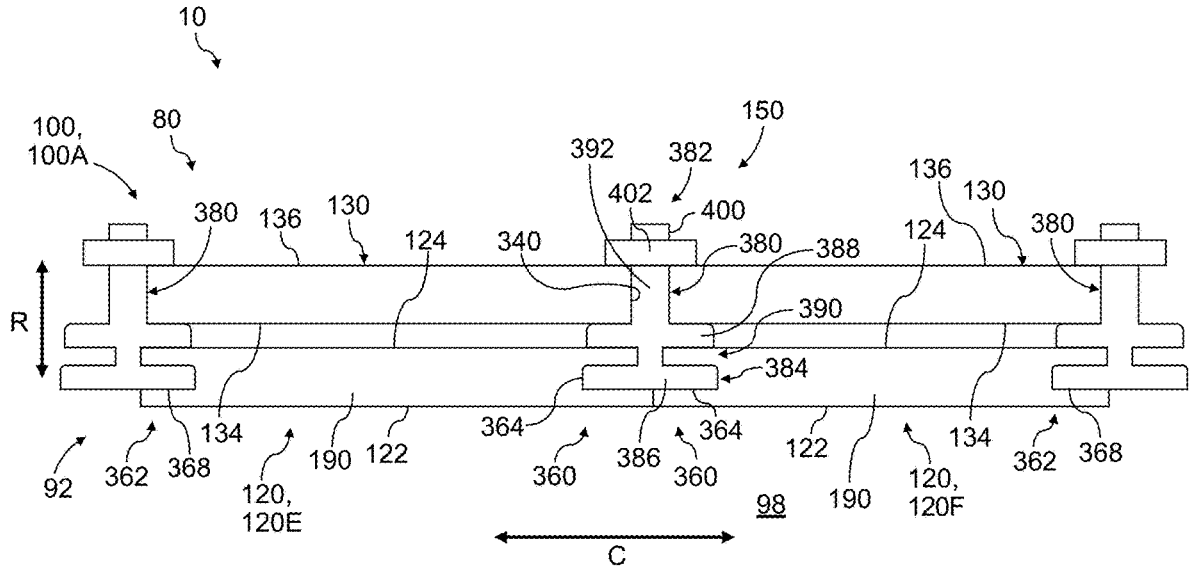
FIG. 8 is a schematic enlarged view of a portion of an exemplary combustor assembly in accordance with an exemplary embodiment of the present disclosure.

FIG. 8 is a schematic, enlarged view of a portion of the combustor assembly 80 in accordance with an exemplary aspect of the present disclosure. The exemplary combustor assembly 80 of FIG. 8 may be configured in substantially the same manner as the exemplary combustor assembly 80 of FIGS. 2-7, and accordingly, the same or similar numbers may refer to the same or similar parts. For example, the exemplary combustor assembly 80 of FIG. 8 generally includes a combustor liner support shell 130 and a plurality of liner tiles 120 defining at least part of a combustion chamber 98.

As shown in FIG. 8, the plurality of liner tiles 120 includes a liner tile 120E positioned adjacent a liner tile 120F along the circumferential direction C. The liner tile 120E defines a liner tile end 360 and a liner tile end 362 opposite the liner tile end 360. In the illustrated embodiment, the liner tile ends 360, 362 are at circumferentially opposite ends of the liner tile 120. The liner tile ends 360 of the liner tiles 120E, 120F each define a recess 364. The recesses 364 of the adjacent liner tiles 120E, 120F face each other. The liner tile ends 362 of the adjacent liner tiles 120E, 120F each define a recess 368. In exemplary embodiments, the liner tile end 360 may be configured the same as the liner tile end 362 (e.g., the recesses 364 and 368 may be configured the same as each other).

In the embodiment depicted in FIG. 8, the fastener assembly 150 includes an insert 380 used to couple the liner tiles 120E, 120F to the combustor liner support shell 130. In the illustrated embodiment of FIG. 8, the insert 380 is an elongate member defining an end 382 and an end 384 opposite the end 382 in the radial direction. The end 384 of the insert 380 defines a protrusion 386. The insert 380 also includes a protrusion 388 spaced apart from the protrusion 386 in a radially outward direction defining an insert recess 390 therebetween. The protrusion 386 is disposed in the recesses 364 of the adjacent liner tiles 120E, 120F. The protrusion 388 is disposed between the outer surface 124 of the respective liner tiles 120E, 120F and the inner surface 134 of the combustor liner support shell 130.

The insert 380 includes an extension portion 392 extending from the protrusion 388 toward the end 382 and extends through the aperture 340 in the combustor liner support shell 130. In the embodiment illustrated in FIG. 8, the insert 380 includes an externally threaded portion 400 at the end 382. A securing member 402 such as, by of non-limiting example, a nut, threadably engages the externally threaded portion 400 of the insert 380 to secure the insert 380 and the liner tiles 120E, 120F to the combustor liner support shell 130. Further, the recesses 364, 368 and/or the protrusions 386, 388 may be configured or sized to interlock the liner tiles 120 but permit limited movement of the liner tiles 120 and the combustor liner support shell 130 with respect to each other to enable expansion and contraction in response to thermal gradients within the combustion chamber 98.

Figure 9:
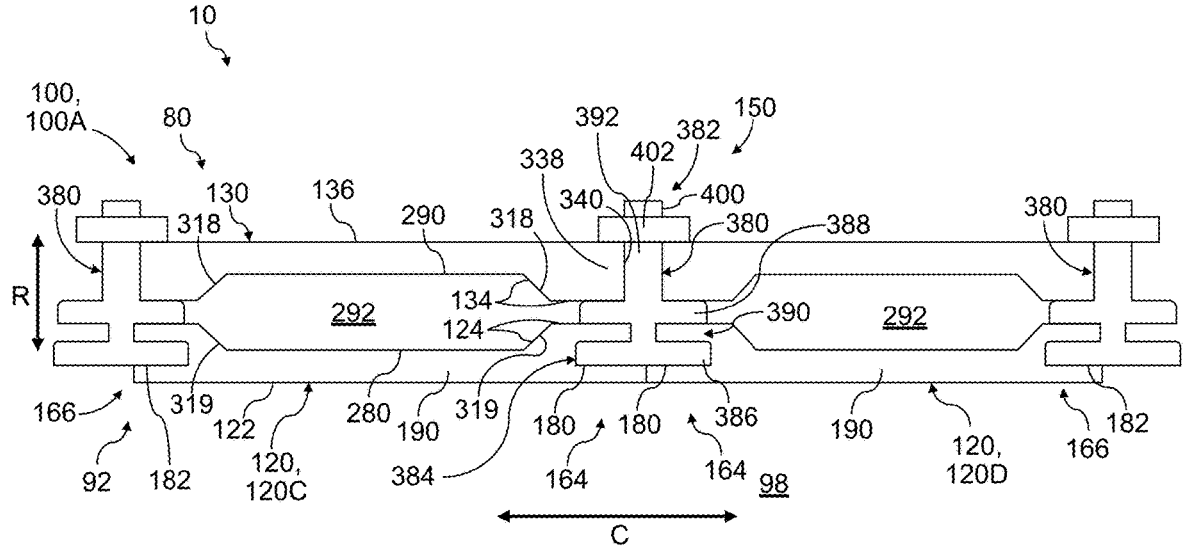
FIG. 9 is a schematic enlarged view of a portion of an exemplary combustor assembly in accordance with an exemplary embodiment of the present disclosure.

FIG. 9 is a schematic, enlarged view of a portion of the combustor assembly 80 in accordance with an exemplary aspect of the present disclosure. The exemplary combustor assembly 80 of FIG. 9 may be configured in substantially the same manner as the exemplary combustor assembly 80 of FIGS. 2-8, and accordingly, the same or similar numbers may refer to the same or similar parts. For example, the exemplary combustor assembly 80 of FIG. 9 generally includes a combustor liner support shell 130 and a plurality of liner tiles 120 defining at least part of a combustion chamber 98.

In the embodiment illustrated in FIG. 9, the plurality of the liner tiles 120 include the liner tiles 120C, 120D as depicted and described previously in connection with FIGS. 6 and 7. The combustor liner support shell 130 in FIG. 9 may be configured similar to the combustor support shell 130 of FIG. 7 having the platform 338 and the support shell channel 290 facing the liner tile channel 280. Further, the insert 380 as depicted and described in connection with FIG. 8 is used to couple the liner tiles 120C, 120D to the combustor liner support shell 130. As illustrated in FIG. 9, the protrusion 386 is disposed in the recesses 180 of the liner tiles 120C, 12D, and the protrusion 388 is disposed between the outer surfaces 124 of the liner tiles 120C, 120D and the inner surface 134 of the combustor liner support shell 130. The extension portion 392 extends through at least a portion of the combustor liner support shell 130 via the aperture 340. The end 382 of the insert 380 includes the externally threaded portion 400, and the securing member 402 threadably engages the externally threaded portion 400 to secure the insert 380 and the liner tiles 120C, 120D to the combustor liner support shell 130. As described above, the recesses 180, 182 and/or the protrusions 386, 388 may be configured or sized to interlock the liner tiles 120 but permit limited movement of the liner tiles 120 with respect to each other and the combustor liner support shell 130 to enable expansion and contraction in response to thermal gradients within the combustion chamber 98.

Figure 10:
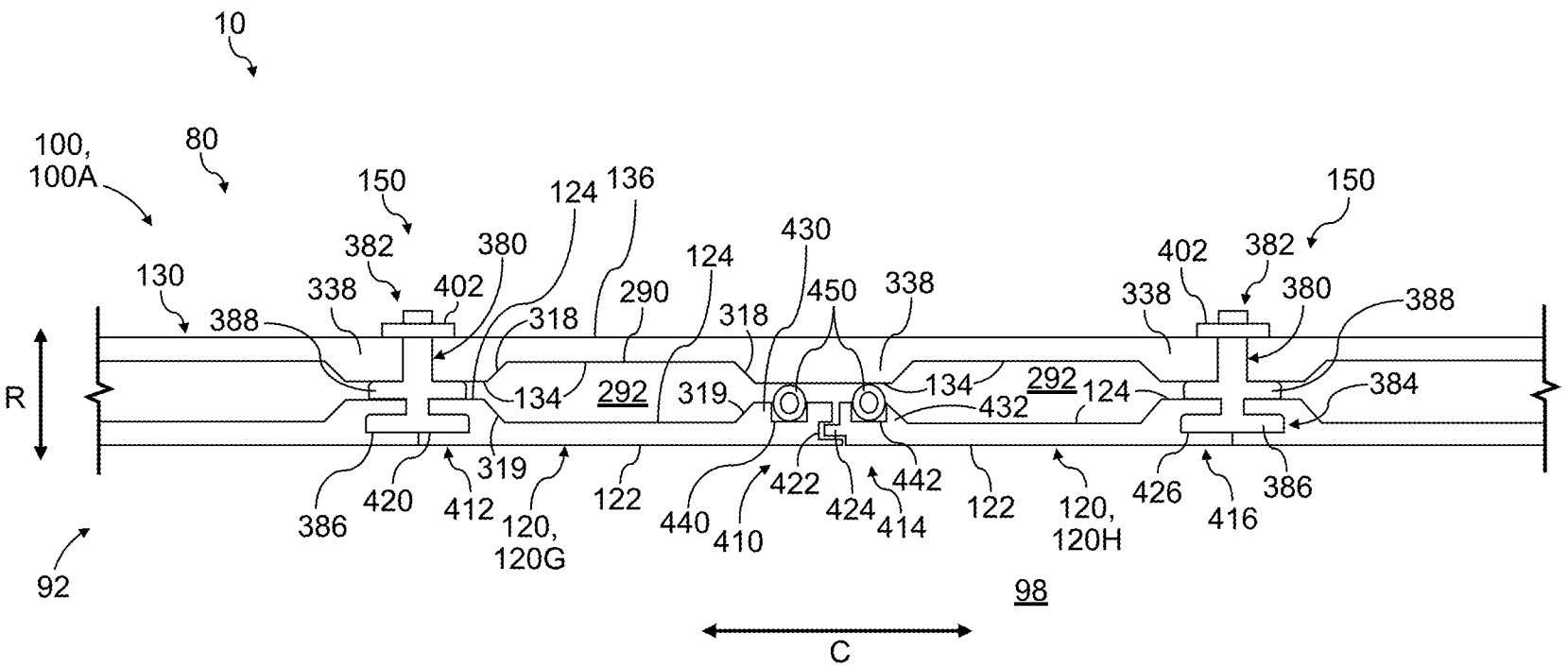
FIG. 10 is a schematic enlarged view of a portion of an exemplary combustor assembly in accordance with an exemplary embodiment of the present disclosure.

FIG. 10 is a schematic, enlarged view of a portion of the combustor assembly 80 in accordance with an exemplary aspect of the present disclosure. The exemplary combustor assembly 80 of FIG. 10 may be configured in substantially the same manner as the exemplary combustor assembly 80 of FIGS. 2-9, and accordingly, the same or similar numbers may refer to the same or similar parts. For example, the exemplary combustor assembly 80 of FIG. 10 generally includes the combustor liner support shell 130 and a plurality of liner tiles 120 defining at least part of a combustion chamber 98. However, for the embodiment of FIG. 10, an alternative configuration for securing and interlocking adjacent liner tiles 120 is provided.

As shown in FIG. 10, the plurality of liner tiles 120 includes a liner tile 120G and a liner tile 120H positioned adjacent to one another along the circumferential direction C. The liner tiles 120G, 120H are configured with alternating interlocking and sealing features. For example, the liner tile 120G defines a recess 420 at a liner tile end 412 and a recess 422 at a liner tile end 410 opposite the liner tile end 412. Thus, in the embodiment illustrated in FIG. 10, the liner tile ends 410, 412 define opposite circumferential ends of the liner tile 120G. The liner tile 120H defines a protrusion 424 at a liner tile end 414 and a recess 426 at a liner tile end 416 opposite the liner tile end 414. Thus, in the embodiment illustrated in FIG. 10, the liner tile ends 414, 416 define opposite circumferential ends of the liner tile 120H. In the arrangement of FIG. 10, the recess 422 of the liner tile 120G is configured to at least partially receive the protrusion 424 of the liner tile 120H.

In the embodiment depicted in FIG. 10, the insert 380 as depicted and described previously in connection with FIGS. 8 and 9 is used to couple the liner tile end 412 of the liner tile 120G to the combustor liner support shell 130, and another of the insert 380 is used to couple the liner tile end 416 of the liner tile 120H to the combustor liner support shell 130. Thus, in the embodiment illustrated in FIG. 10, the protrusion 386 of the insert 380 is disposed in the recess 420 of the liner tile 120G, and the protrusion 388 is disposed between the outer surface 124 of the liner tile 120G and the inner surface 134 of the combustor liner support shell 130. Similarly, the protrusion 386 of another insert 380 is disposed in the recess 426 of the liner tile 120H, and the protrusion 388 is disposed between the outer surface 124 of the liner tile 120H and the inner surface 134 of the combustor liner support shell 130. The securing member 402 couples the respective inserts 380 to the combustor liner support shell 130.

At the interface between the liner tiles 120G, 120H, at the respective liner tile ends 410, 414, a sealing mechanism is provided between the respective liner tiles 120G, 120H and the combustor liner support shell 130. In the embodiment illustrated in FIG. 10, the liner tile end 410 of the liner tile 120G includes a platform 430 defining a recess 440 facing radially outward toward the combustor liner support shell 130. Further, the liner tile end 414 of the liner tile 120H includes a platform 432 defining a recess 442 facing radially outward toward the combustor liner support shell 130. In the embodiment illustrated in FIG. 10, the combustor liner support shell 130 defines the platform 338 facing radially inward toward the liner tiles 120G, 120H. A spline seal 450 is disposed in each of the recesses 440, 442 extending to the platform 338 of the combustor liner support shell 130. The spline seals 450 enable limited radial movement of the liner tiles 120G, 120H, support the liner tile ends 410, 414 of the respective liner tiles 120G, 120H with respect to the combustor liner support shell 130, and create a fluid barrier between adjacent cooling air cavities 292 defined by the respective liner tiles 120G, 120H. Additionally, the recesses 420, 422, 426 and/or the protrusions 386, 388, 424 may be configured or sized to interlock the liner tiles 120 but permit limited movement of the liner tiles 120 with respect to each other and the combustor liner support shell 130 to enable expansion and contraction in response to thermal gradients within the combustion chamber 98.

Thus, embodiments of the present disclosure provide a combustor assembly for a gas turbine engine including a plurality of liner tiles defining at least a portion of a combustor liner of a combustor of a gas turbine engine. Embodiments of the present disclosure secure the liner tiles to each other and the support structure in a plurality of different arrangements that shield the connecting hardware from direct impingement by combustion gases present within the combustion chamber. In one exemplary embodiment, the connection arrangement uses a combination of recesses and protrusions arranged such that fastening elements are positioned within the recesses such that the fastening elements are not exposed within the combustion chamber. In exemplary embodiments, the interlocking of the liner tiles also permits the liner tiles to expand or contract in response to thermal cycling. This flexibility can allow for controlled movement of each liner tile within defined limits, thereby improving durability by reducing undesired thermally-induced stress concentrations at the tile joints. Further, in exemplary embodiments, the liner tile arrangement enables cooling airflows to be routed to the liner tiles and the connection elements, and may provide for film cooling of the liner tiles.

Although specific features of various embodiments may be shown in some drawings and not in others, this is for convenience only. In accordance with the principles of the present disclosure, any feature of a drawing may be referenced and/or claimed in combination with any feature of any other drawing.

Further aspects of the disclosure are provided by the subject matter of the following clauses:

A combustor assembly for a gas turbine engine, the gas turbine engine including a combustor defining a combustion chamber, the combustor assembly comprising: a combustor liner support shell; a plurality of liner tiles defining at least part of the combustion chamber, wherein each liner tile of the plurality of liner tiles defines a protrusion and a recess opposite the protrusion, wherein the recess is configured to at least partially receive the protrusion of an adjacent liner tile of the plurality of liner tiles; and a fastener assembly at least partially disposed in the recess for coupling a respective liner tile to the combustor liner support shell.

The combustor assembly of the preceding clause, wherein each liner tile of the plurality of liner tiles defines a first liner tile end and a second liner tile end opposite the first liner tile end, and wherein the recess is positioned at the first liner tile end, and wherein the protrusion is positioned at the second liner tile end.

The combustor assembly of any preceding clause, wherein each liner tile of the plurality of liner tiles defines a liner tile panel defining at least part of the combustion chamber and an attachment flange spaced apart from the liner tile panel to define the recess.

The combustor assembly of any preceding clause, wherein each liner tile of the plurality of liner tiles defines a support flange extending from the liner tile panel to the attachment flange.

The combustor assembly of any preceding clause, wherein at least a portion of the fastener assembly extends through the attachment flange and the combustor liner support shell.

The combustor assembly of any preceding clause, wherein each liner tile of the plurality of liner tiles comprises: a liner tile panel defining at least part of the combustion chamber; a support flange extending radially from the liner tile panel and defining at least part of the recess; and a support leg extending radially from the liner tile panel and spaced apart from the support flange, the support leg supporting the protrusion.

The combustor assembly of any preceding clause, wherein the liner tile panel, the support flange, and the support leg define a cooling air cavity between the respective liner tile and the combustor liner support shell.

The combustor assembly of any preceding clause, wherein the plurality of liner tiles define an outer combustor liner, and wherein the combustor liner support shell is positioned radially outward from the plurality of liner tiles.

The combustor assembly of any preceding clause, wherein each liner tile of the plurality of liner tiles comprises: a liner tile panel defining at least part of the combustion chamber, the liner tile panel defining one or more liner tile cooling apertures; a support flange extending radially from the liner tile panel and defining at least part of the recess; and a support leg extending radially from the liner tile panel and spaced apart from the support flange, the support leg supporting the protrusion; and wherein the combustor liner support shell defines one or more support shell apertures to allow a cooling airflow to flow to the one or more liner tile cooling apertures.

The combustor assembly of any preceding clause, wherein each liner tile of the plurality of liner tiles defines a liner tile panel defining at least part of the combustion chamber and an attachment flange spaced apart from the liner tile panel to define at least part of the recess, and wherein the fastener assembly comprises: a fastener extending through the combustor liner support shell and the attachment flange; and a securing member positioned within the recess to engage the fastener to couple the attachment flange to the combustor liner support shell.

The combustor assembly of any preceding clause, wherein each liner tile of the plurality of liner tiles comprises: a liner tile panel defining at least part of the combustion chamber; an attachment flange positioned spaced apart from the liner tile panel; and a support flange extending radially from the liner tile panel to the attachment flange, wherein the liner tile panel, the attachment flange, and the support flange define the recess, the recess having an open end at a liner tile end of the respective liner tile, and wherein the support flange defines a closed end of the recess; and wherein the fastener assembly is at least partially disposed between the closed end of the recess and the protrusion of the adjacent liner tile.

The combustor assembly of any preceding clause, wherein the protrusion of the adjacent liner tile is positioned within the open end of the recess.

The combustor assembly of any preceding clause, wherein the fastener assembly comprises: a fastener extending through the combustor liner support shell and the attachment flange; and a securing member positioned between the protrusion and the closed end of the recess to engage the fastener.

A combustor assembly for a gas turbine engine, the combustor assembly comprising: a combustor liner support shell; and a plurality of liner tiles defining at least part of a combustion chamber, wherein the plurality of liner tiles include a first liner tile positioned adjacent a second liner tile, the first liner tile defining a first recess, the second liner tile defining a second recess, and wherein the first and second recesses face each other; an insert defining a first end and a second end opposite the first end, the insert comprising a first protrusion and a second protrusion spaced from the first protrusion adjacent the second end and defining an insert recess therebetween, the first protrusion disposed in the first recess of the first liner tile and the second recess of the second liner tile, the second protrusion disposed between outer surfaces of the first and second liner tiles and an inner surface of the combustor liner support shell; and a fastener coupling the first end of the insert to the combustor liner support shell.

The combustor assembly of any preceding clause, wherein the first end of the insert is threaded.

The combustor assembly of any preceding clause, wherein the first end of the insert is internally threaded.

The combustor assembly of any preceding clause, wherein the first end of the insert is externally threaded.

The combustor assembly of any preceding clause, wherein at least a portion of the insert extends through at least a portion of the combustor liner support shell.

The combustor assembly of any preceding clause, wherein the combustor liner support shell comprises a first combustor liner support shell portion and a second combustor liner support shell portion positioned adjacent the first combustor liner support shell portion, and wherein at least a portion of the insert extends radially between the first and second combustor liner support shell portions.

The combustor assembly of any preceding clause, wherein the insert recess comprises a first insert recess, and wherein the insert comprises a third protrusion spaced apart from the second protrusion and defining a second insert recess therebetween, and wherein at least a portion of the combustor liner support shell is positioned in the second insert recess.

The combustor assembly of any preceding clause, wherein the first end of the insert comprises an internally threaded portion.

The combustor assembly of any preceding clause, wherein the fastener comprises an externally threaded portion for threadably engaging the internally threaded portion of the insert.

The combustor assembly of any preceding clause, wherein the first end of the insert comprises an externally threaded portion.

The combustor assembly of any preceding clause, wherein at least one liner tile of the first and second liner tiles comprises a third recess facing the combustor liner support shell.

The combustor assembly of any preceding clause, further comprising a spline seal positioned at least partly in the third recess.

The combustor assembly of any preceding clause, wherein the spline seal extends from the third recess to the combustor liner support shell.

The combustor assembly of any preceding clause, wherein at least one liner tile of the first and second liner tiles comprises a liner tile channel defined on the outer surface of the at least one liner tile.

The combustor assembly of any preceding clause, wherein the inner surface of the combustor liner support shell comprises a support shell channel facing the liner tile channel.

The combustor assembly of any preceding clause, wherein a cooling air cavity is defined between at least one liner tile of the first and second liner tiles and the combustor liner support shell.

The combustor assembly of any preceding clause, wherein the cooling air cavity is at least partly defined by a pair of sloped surfaces formed on an outer surface of the at least one liner tile and a pair of sloped surfaces formed on an inner surface of the combustor liner support shell.

The combustor assembly of any preceding clause, wherein the combustor liner support shell comprises a first combustor liner support shell portion and a second combustor liner support shell portion positioned adjacent the first combustor liner support shell portion, and wherein the first end of the insert is coupled to the first and second combustor liner support shell portions.

The combustor assembly of any preceding clause, wherein the first liner tile comprises a third recess opposite the first recess, and wherein the combustor liner support shell comprises a fourth recess spaced radially apart from the third recess, and further comprising a connector element having first and second spaced apart protrusions, and wherein the first protrusion of the connector element is disposed within the third recess, and wherein the second protrusion of the connector element is disposed within the fourth recess.

A combustor assembly for a gas turbine engine, the combustor assembly comprising: a combustor liner support shell; a plurality of liner tiles defining at least part of the combustion chamber, wherein the plurality of liner tiles comprises: a first liner tile defining a recess; and a second liner tile positioned adjacent the first liner tile, the second liner tile defining a protrusion, and wherein the recess is configured to at least partially receive the protrusion; a fastener extending through the combustor liner support shell and at least a portion of the first liner tile; and a securing member coupled to the first liner tile within the recess to engage the fastener.

The combustor assembly of any preceding clause, wherein the first liner tile comprises an attachment flange defining at least part of the recess, and wherein the fastener extends through the attachment flange.

The combustor assembly of any preceding clause, wherein the first liner tile comprises: a liner tile panel defining at least part of the combustion chamber; an attachment flange spaced radially apart from the liner tile panel; and a support flange extending radially from the liner tile panel to the attachment flange, and wherein the liner tile panel, the attachment flange, and the support flange define the recess.

The combustor assembly of any preceding clause, wherein the liner tile panel defines one or more liner tile cooling apertures.

The combustor assembly of any preceding clause, wherein the attachment flange is positioned against an inner surface of the combustor liner support shell.

The combustor assembly of any preceding clause, wherein the securing member is positioned between the support flange and the protrusion.

The combustor assembly of any preceding clause, wherein the first liner tile comprises a liner tile panel defining at least part of the combustion chamber, and further comprising a cooling air cavity defined between the liner tile panel and the combustor liner support shell.

A combustor assembly for a gas turbine engine, the gas turbine engine including a combustor defining a combustion chamber, the combustor assembly comprising: a combustor liner support shell; a plurality of liner tiles defining at least part of the combustion chamber, wherein the plurality of liner tiles comprises a first liner tile and a second liner tile, wherein the first liner tile comprises a first recess and a second recess opposite the first recess, and wherein the second liner tile comprises a protrusion and a third recess opposite the protrusion, and wherein the second recess is configured to at least partially receive the protrusion; a first fastener assembly at least partially disposed in the first recess coupling the first liner tile to the combustor liner support shell; and a second fastener assembly at least partially disposed in the third recess coupling the second liner tile to the combustor liner support shell.

The combustor assembly of any preceding clause, wherein the first liner tile comprises a fourth recess facing the combustor liner support shell adjacent the second recess, and wherein the second liner tile comprises a fifth recess facing the combustor liner support shell adjacent the protrusion.

The combustor assembly of any preceding clause, wherein a spline seal is disposed in each of the fourth and fifth recesses extending to the combustor liner support shell.

The combustor assembly of any preceding clause, wherein the first and second fastener assemblies each comprise an insert having at least one protrusion, the at least one protrusion of the insert disposed at least partially within the respective first recess and third recess of the respective first and second liner tiles.

A gas turbine engine, comprising: a fan section comprising a fan; and a turbomachine drivably coupled to the fan, the turbomachine comprising a compressor section, a combustion section, and a turbine section in serial flow order, the combustion section comprising: a combustor liner support shell; a plurality of liner tiles defining at least part of the combustion chamber, wherein each liner tile of the plurality of liner tiles defines a protrusion and a recess opposite the protrusion, wherein the recess is configured to at least partially receive the protrusion of an adjacent liner tile of the plurality of liner tiles; and a fastener assembly at least partially disposed in the recess for coupling a respective liner tile to the combustor liner support shell.

The gas turbine engine of any preceding clause, wherein each liner tile of the plurality of liner tiles defines a first liner tile end and a second liner tile end opposite the first liner tile end, and wherein the recess is positioned at the first liner tile end, and wherein the protrusion is positioned at the second liner tile end.

The gas turbine engine of any preceding clause, wherein each liner tile of the plurality of liner tiles defines a liner tile panel defining at least part of the combustion chamber and an attachment flange spaced apart from the liner tile panel to define the recess.

The gas turbine engine of any preceding clause, wherein each liner tile of the plurality of liner tiles defines a support flange extending from the liner tile panel to the attachment flange.

The gas turbine engine of any preceding clause, wherein at least a portion of the fastener assembly extends through the attachment flange and the combustor liner support shell.

The gas turbine engine of any preceding clause, wherein each liner tile of the plurality of liner tiles comprises: a liner tile panel defining at least part of the combustion chamber; a support flange extending radially from the liner tile panel and defining at least part of the recess; and a support leg extending radially from the liner tile panel and spaced apart from the support flange, the support leg supporting the protrusion.

The gas turbine engine of any preceding clause, wherein the liner tile panel, the support flange, and the support leg define a cooling air cavity between the respective liner tile and the combustor liner support shell.

The gas turbine engine of any preceding clause, wherein the plurality of liner tiles define an outer combustor liner, and wherein the combustor liner support shell is positioned radially outward from the plurality of liner tiles.

The gas turbine engine of any preceding clause, wherein each liner tile of the plurality of liner tiles comprises: a liner tile panel defining at least part of the combustion chamber, the liner tile panel defining one or more liner tile cooling apertures; a support flange extending radially from the liner tile panel and defining at least part of the recess; and a support leg extending radially from the liner tile panel and spaced apart from the support flange, the support leg supporting the protrusion;

and wherein the combustor liner support shell defines one or more support shell apertures to allow a cooling airflow to flow to the one or more liner tile cooling apertures.

The gas turbine engine of any preceding clause, wherein each liner tile of the plurality of liner tiles defines a liner tile panel defining at least part of the combustion chamber and an attachment flange spaced apart from the liner tile panel to define at least part of the recess, and wherein the fastener assembly comprises: a fastener extending through the combustor liner support shell and the attachment flange; and a securing member positioned within the recess to engage the fastener to couple the attachment flange to the combustor liner support shell.

The gas turbine engine of any preceding clause, wherein each liner tile of the plurality of liner tiles comprises: a liner tile panel defining at least part of the combustion chamber; an attachment flange positioned spaced apart from the liner tile panel; and a support flange extending radially from the liner tile panel to the attachment flange, wherein the liner tile panel, the attachment flange, and the support flange define the recess, the recess having an open end at a liner tile end of the respective liner tile, and wherein the support flange defines a closed end of the recess; and wherein the fastener assembly is at least partially disposed between the closed end of the recess and the protrusion of the adjacent liner tile.

The gas turbine engine of any preceding clause, wherein the protrusion of the adjacent liner tile is positioned within the open end of the recess.

A gas turbine engine, comprising: a fan section comprising a fan; and a turbomachine drivably coupled to the fan, the turbomachine comprising a compressor section, a combustion section, and a turbine section in serial flow order, the combustion section comprising: a combustor liner support shell; and a plurality of liner tiles defining at least part of a combustion chamber, wherein the plurality of liner tiles include a first liner tile positioned adjacent a second liner tile, the first liner tile defining a first recess, the second liner tile defining a second recess, and wherein the first and second recesses face each other; an insert defining a first end and a second end opposite the first end, the insert comprising a first protrusion and a second protrusion spaced from the first protrusion adjacent the second end and defining an insert recess therebetween, the first protrusion disposed in the first recess of the first liner tile and the second recess of the second liner tile, the second protrusion disposed between outer surfaces of the first and second liner tiles and an inner surface of the combustor liner support shell; and a fastener coupling the first end of the insert to the combustor liner support shell.

The gas turbine engine of any preceding clause, wherein the first end of the insert is threaded.

The gas turbine engine of any preceding clause, wherein the first end of the insert is internally threaded.

The gas turbine engine of any preceding clause, wherein the first end of the insert is externally threaded.

The gas turbine engine of any preceding clause, wherein at least a portion of the insert extends through at least a portion of the combustor liner support shell.

The gas turbine engine of any preceding clause, wherein the combustor liner support shell comprises a first combustor liner support shell portion and a second combustor liner support shell portion positioned adjacent the first combustor liner support shell portion, and wherein at least a portion of the insert extends radially between the first and second combustor liner support shell portions.

The gas turbine engine of any preceding clause, wherein the insert recess comprises a first insert recess, and wherein the insert comprises a third protrusion spaced apart from the second protrusion and defining a second insert recess therebetween, and wherein at least a portion of the combustor liner support shell is positioned in the second insert recess.

The gas turbine engine of any preceding clause, wherein the first end of the insert comprises an internally threaded portion.

The gas turbine engine of any preceding clause, wherein the fastener comprises an externally threaded portion for threadably engaging the internally threaded portion of the insert.

The gas turbine engine of any preceding clause, wherein the first end of the insert comprises an externally threaded portion.

The gas turbine engine of any preceding clause, wherein at least one liner tile of the first and second liner tiles comprises a third recess facing the combustor liner support shell.

The gas turbine engine of any preceding clause, further comprising a spline seal positioned at least partly in the third recess.

The gas turbine engine of any preceding clause, wherein the spline seal extends from the third recess to the combustor liner support shell.

The gas turbine engine of any preceding clause, wherein at least one liner tile of the first and second liner tiles comprises a liner tile channel defined on the outer surface of the at least one liner tile.

The gas turbine engine of any preceding clause, wherein the inner surface of the combustor liner support shell comprises a support shell channel facing the liner tile channel.

The gas turbine engine of any preceding clause, wherein a cooling air cavity is defined between at least one liner tile of the first and second liner tiles and the combustor liner support shell.

The gas turbine engine of any preceding clause, wherein the cooling air cavity is at least partly defined by a pair of sloped surfaces formed on an outer surface of the at least one liner tile and a pair of sloped surfaces formed on an inner surface of the combustor liner support shell.

The gas turbine engine of any preceding clause, wherein the combustor liner support shell comprises a first combustor liner support shell portion and a second combustor liner support shell portion positioned adjacent the first combustor liner support shell portion, and wherein the first end of the insert is coupled to the first and second combustor liner support shell portions.

The gas turbine engine of any preceding clause, wherein the first liner tile comprises a third recess opposite the first recess, and wherein the combustor liner support shell comprises a fourth recess spaced radially apart from the third recess, and further comprising a connector element having first and second spaced apart protrusions, and wherein the first protrusion of the connector element is disposed within the third recess, and wherein the second protrusion of the connector element is disposed within the fourth recess.

A gas turbine engine, comprising: a fan section comprising a fan; and a turbomachine drivably coupled to the fan, the turbomachine comprising a compressor section, a combustion section, and a turbine section in serial flow order, the combustion section comprising: a combustor liner support shell; a plurality of liner tiles defining at least part of the combustion chamber, wherein the plurality of liner tiles comprises a first liner tile and a second liner tile, wherein the first liner tile comprises a first recess and a second recess opposite the first recess, and wherein the second liner tile comprises a protrusion and a third recess opposite the protrusion, and wherein the second recess is configured to at least partially receive the protrusion; a first fastener assembly at least partially disposed in the first recess coupling the first liner tile to the combustor liner support shell; and a second fastener assembly at least partially disposed in the third recess coupling the second liner tile to the combustor liner support shell.

The gas turbine engine of any preceding clause, wherein the first liner tile comprises a fourth recess facing the combustor liner support shell adjacent the second recess, and wherein the second liner tile comprises a fifth recess facing the combustor liner support shell adjacent the protrusion.

The gas turbine engine of any preceding clause, wherein a spline seal is disposed in each of the fourth and fifth recesses extending to the combustor liner support shell.

The gas turbine engine of any preceding clause, wherein the first and second fastener assemblies each comprise an insert having at least one protrusion, the at least one protrusion of the insert disposed at least partially within the respective first recess and third recess of the respective first and second liner tiles.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly for a gas turbine engine, the gas turbine engine including a combustor defining a combustion chamber, the combustor assembly comprising:

a combustor liner support shell;

a plurality of liner tiles defining at least part of the combustion chamber, wherein each liner tile of the plurality of liner tiles defines a protrusion and a recess opposite the protrusion, wherein the recess is configured to at least partially receive the protrusion of an adjacent liner tile of the plurality of liner tiles; and a fastener assembly at least partially disposed in the recess for coupling a respective liner tile to the combustor liner support shell, wherein each liner tile of the plurality of liner tiles defines a liner tile panel defining at least part of the combustion chamber; an attachment flange spaced apart from the liner tile panel to define the recess; and a support flange extending from the liner tile panel to the attachment flange, and wherein at least a portion of the fastener assembly extends through the attachment flange and the combustor liner support shell.

2. The combustor assembly of claim 1, wherein each liner tile of the plurality of liner tiles defines a first liner tile end and a second liner tile end opposite the first liner tile end, and wherein the recess is positioned at the first liner tile end, and wherein the protrusion is positioned at the second liner tile end.

3. The combustor assembly of claim 1, wherein each liner tile of the plurality of liner tiles comprises:

the support flange extending radially from the liner tile panel and defining at least part of the recess; and a support leg extending radially from the liner tile panel and spaced apart from the support flange, the support leg supporting the protrusion.

4. The combustor assembly of claim 3, wherein the liner tile panel, the support flange, and the support leg define a cooling air cavity between the respective liner tile and the combustor liner support shell.

5. The combustor assembly of claim 1, wherein the plurality of liner tiles define an outer combustor liner, and wherein the combustor liner support shell is positioned radially outward from the plurality of liner tiles.

6. The combustor assembly of claim 1, wherein each liner tile of the plurality of liner tiles comprises:

the liner tile panel defining one or more liner tile cooling apertures;

the support flange extending radially from the liner tile panel and defining at least part of the recess; and a support leg extending radially from the liner tile panel and spaced apart from the support flange, the support leg supporting the protrusion; and wherein the combustor liner support shell defines one or more support shell apertures to allow a cooling airflow to flow to the one or more liner tile cooling apertures.

7. The combustor assembly of claim 1, wherein the fastener assembly comprises:

a fastener extending through the combustor liner support shell and the attachment flange; and a securing member positioned within the recess to engage the fastener to couple the attachment flange to the combustor liner support shell.

8. The combustor assembly of claim 1, wherein each liner tile of the plurality of liner tiles comprises:

the support flange extending radially from the liner tile panel to the attachment flange, wherein the liner tile panel, the attachment flange, and the support flange define the recess, the recess having an open end at a liner tile end of the respective liner tile, and wherein the support flange defines a closed end of the recess; and wherein the fastener assembly is at least partially disposed between the closed end of the recess and the protrusion of the adjacent liner tile.

9. The combustor assembly of claim 8, wherein the protrusion of the adjacent liner tile is positioned within the open end of the recess.

10. The combustor assembly of claim 8, wherein the fastener assembly comprises:

a fastener extending through the combustor liner support shell and the attachment flange; and a securing member positioned between the protrusion and the closed end of the recess to engage the fastener.

11. A combustor assembly for a gas turbine engine, the combustor assembly comprising:

a combustor liner support shell;

a plurality of liner tiles defining at least part of the combustion chamber, wherein the plurality of liner tiles comprises:

a first liner tile defining a recess; and a second liner tile positioned adjacent the first liner tile, the second liner tile defining a protrusion, and wherein the recess is configured to at least partially receive the protrusion;

a fastener extending through the combustor liner support shell and at least a portion of the first liner tile; and a securing member coupled to the first liner tile within the recess to engage the fastener.

12. The combustor assembly of claim 11, wherein the first liner tile comprises an attachment flange defining at least part of the recess, and wherein the fastener extends through the attachment flange.

13. The combustor assembly of claim 12, wherein the first liner tile comprises a liner tile panel defining at least part of the combustion chamber, and further comprising a cooling air cavity defined between the liner tile panel and the combustor liner support shell.

14. The combustor assembly of claim 11, wherein the first liner tile comprises:

a liner tile panel defining at least part of the combustion chamber;

an attachment flange spaced radially apart from the liner tile panel; and a support flange extending radially from the liner tile panel to the attachment flange, and wherein the liner tile panel, the attachment flange, and the support flange define the recess.

15. The combustor assembly of claim 14, wherein the liner tile panel defines one or more liner tile cooling apertures.

16. The combustor assembly of claim 14, wherein the attachment flange is positioned against an inner surface of the combustor liner support shell.

17. The combustor assembly of claim 14, wherein the securing member is positioned between the support flange and the protrusion.

* * * * *